US011462075B1

(12) United States Patent
Williams

(10) Patent No.: US 11,462,075 B1
(45) Date of Patent: Oct. 4, 2022

(54) SYSTEMS AND METHODS FOR FACILITATING DATA COLLECTION

(71) Applicant: Anthony Marc Williams, Macomb, MI (US)

(72) Inventor: Anthony Marc Williams, Macomb, MI (US)

( * ) Notice: Subject to any disclaimer, the term of this patent is extended or adjusted under 35 U.S.C. 154(b) by 3 days.

(21) Appl. No.: 17/070,813

(22) Filed: Oct. 14, 2020

Related U.S. Application Data

(60) Provisional application No. 62/914,947, filed on Oct. 14, 2019, provisional application No. 62/914,945, filed on Oct. 14, 2019.

(51) Int. Cl.
*G07F 17/32* (2006.01)

(52) U.S. Cl.
CPC ..... *G07F 17/3239* (2013.01); *G07F 17/3255* (2013.01)

(58) Field of Classification Search
CPC ..... G07F 17/3239
See application file for complete search history.

(56) References Cited

U.S. PATENT DOCUMENTS

2011/0309577 A1* 12/2011 Vicens ..... G07F 17/3216 273/148 R
2013/0225279 A1* 8/2013 Patceg ..... G07F 17/3211 463/29
2014/0323210 A1* 10/2014 Patceg ..... G07F 17/3204 463/25
2018/0108207 A1* 4/2018 Lyons ..... G07F 17/3211
2019/0371110 A1* 12/2019 Higgins ..... A63F 3/00157
2020/0111279 A1* 4/2020 Cleveland ..... G07F 17/3223
2020/0302740 A1* 9/2020 Cleveland ..... G06Q 20/3276
2020/0302746 A1* 9/2020 Cleveland ..... G07F 17/3227
2021/0295636 A1* 9/2021 Cleveland ..... G06Q 30/0226
2021/0335091 A1* 10/2021 Palmisano ..... G07F 17/3225
2021/0343103 A1* 11/2021 Cleveland ..... G06Q 30/0226
2021/0350668 A1* 11/2021 Page ..... G07F 17/3211

* cited by examiner

*Primary Examiner* — Jay Trent Liddle
(74) *Attorney, Agent, or Firm* — Newman Law, LLC

(57) ABSTRACT

Customer management systems including a wireless puck device to facilitate concurrent communication with one or more customers having one or more customer user devices located within a certain range or proximity of a customer service point, the wireless puck device establishing a wireless connection with the customer user devices for data transfer, whereby the wireless puck device receives customer data, such as a customer or player identification number, the customer data either being stored in memory residing in the wireless puck device for subsequent communication with a customer management system or transmitted from the wireless puck device to the customer management system, wherein the wireless puck device and customer user device may further interact and communicate so that additional customer activity at the customer service point is associated with the customer and stored or transmitted to the customer management system. The customer management system may include a casino patron or player loyalty program management system and the customer service point may include a live table game operated at the casino.

3 Claims, 8 Drawing Sheets

SYSTEMS AND METHODS FOR FACILITATING DATA COLLECTION

CROSS-REFERENCE TO RELATED APPLICATIONS

This application claims the priority benefit of U.S. provisional patent application No. 62/914,945 filed on Oct. 14, 2019 and U.S. provisional patent application No. 62/914,947 filed on Oct. 14, 2019, the disclosures of which are incorporated herein by reference.

FIELD OF THE INVENTION

The present invention relates to a wireless puck device designed to facilitate the concurrent transmission of customer data, such as customer identification information, from a plurality of customers in proximity of a customer service point, such as a live table game or point of service (POS) terminal, using customer mobile devices, such as customer smartphones, whereby customers can connect with each other and/or a customer management system associated with the customer service point.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in-and-of-themselves may also be inventions within the scope of the disclosure herein.

Typically, at a service point such as a restaurant or bar, customers are incentivized to use the customer loyalty cards associated with themselves and a pre-established customer loyalty account to gain additional rewards in an entertainment facility. However, using the customer cards at a service point is inefficient and requires the manual intervention of the customers and service point staffs. Furthermore, only the loyalty numbers of the customer paying the bill are tracked, typically leaving all other guests untracked. Therefore, there is a need for a more efficient and comprehensive system and method for obtaining and tracking customers through their respective customer loyalty numbers.

For example, casinos have a demonstrated interest in player loyalty programs for casino customers. While customers are provided with player loyalty cards, it is difficult to use such cards at customer services points such as live table games (e.g., Blackjack, Baccarat, Craps, Roulette, etc.) which typically do not have devices for receiving player loyalty cards or tracking customer activity, particularly activity related to wagering involving physical gaming chips, even though this is a type of activity which casino operators desire to track for granting player rewards.

Casino customers remain incentivized to use the player cards associated with themselves and their respective pre-established player accounts in a loyalty or benefits program at table games to gain additional rewards in a casino gaming facility. However, using the player cards at a table game is inefficient at least because at least for the issues discussed above such use requires the manual intervention of both the players and casino staff, such as the dealers who are busy administering the game.

Thus, in view of the above, there is a long-felt need in the industry to address the aforementioned inefficiencies and inadequacies. There is a need for a more efficient system and method to address the aforementioned inefficiencies in obtaining customer information at customer service points for tracking customer activity. For example, as mentioned above, there is a need for a more efficient system and method for capturing player information, such as player card information, at a table game.

Further limitations and disadvantages of conventional and traditional approaches will become apparent to one of skill in the art through comparison of described methods and systems disclosed herein.

SUMMARY OF THE INVENTION

This invention is generally directed to systems and methods which address and resolve the aforementioned issues, among others.

Some embodiments of the invention are directed to systems and methods which incorporate a wireless device of any shape or size, such as a disc or "puck", which is configured to operate at a customer data point for capturing customer data from one or more customers interacting with the customer service point, such as a live table game, and which may further include capturing ongoing customer data relating to specific customer interactions at the customer service point, such as capturing a player identification and/or game play and wagering activity at the live table game.

In some embodiments, the invention is directed to a wireless device referred to hereinafter as a "wireless puck device", which resides at a customer service point, wherein the wireless puck device is configured to communicate wirelessly with a plurality of computing devices, such as customer user devices like smartphones and tablets, to facilitate the concurrent transfer of customer identification information, such as a customer number ("customerId"), and is configured to communicate with a management system, such as the wireless puck device facilitating organization or operator associated with the customer service point.

A wireless puck device of the invention may be activated in a variety of ways, such as for example, being automatically activated responsive to being moved from a dock or cradle or activated through a physical interaction, either with a customer or a service point staff for example.

A wireless puck device of the invention can be provided to a customer, who can hold their user computing device, such as smartphone, within a certain proximity of the wireless puck device, resulting in the activation of a software application residing in memory on the computing device, such as a downloaded app on a smartphone, or initiates a wireless signal, such as NFC connectivity, to facilitate the communication of a customer identification number to the wireless puck device. The wireless puck device may then be retrieved by the service point staff and either immediately or at some later point used to transfer the customer identification number to the service point's management system.

In an aspect, the aforementioned wireless puck device facilitates the service point staff identification of a customer at the service point location to eliminate the need for the person to choose their location, among other things.

In an aspect, the aforementioned wireless puck device can be used to capture the loyalty number of all customers at the restaurant or bar. Currently the capture is limited only to the customers who are paying the bill. This aspect allows for all customers to have their loyalty interactions tracked while in the entertainment facility.

In an aspect, the aforementioned wireless puck device goes into scanning state after selection of the location, so that the user or customers cannot change location.

In an aspect, the aforementioned wireless puck device is utilized by a plurality of customers, which can be positional.

In an aspect, the service point staff puts the aforementioned wireless puck device on the seating position.

In an aspect, the aforementioned wireless puck device can be mounted at each seating position.

In an aspect, preferably, at least one wireless puck device can be placed per table.

In an aspect, the aforementioned wireless puck device can capture a person's customer number and can also capture additional information, such as the time the event occurred, to build an interface to the POS (Point of Sale) or the service point rating systems. This allows the user loyalty assessment to be started when the customer actually begins their entertainment experience.

In an aspect, the aforementioned wireless puck device can be integrated into a keyboard or other standard input device.

In an aspect, the aforementioned wireless puck device can collect multiple numbers from the table, based on the user input.

In an aspect, the aforementioned wireless puck device includes memory that can store data, and a data communication device that can receive data to be stored in the memory and then transmit the stored data later.

In an aspect, the aforementioned wireless puck device includes a data communication device that can establish wireless communication with the computing devices of the customers via wireless modules, such as a Bluetooth Low Energy (BLE) or Near Field Communication (NFC), integrated within the computing devices. The wireless communication between the aforementioned wireless puck device and the computing devices of the customers can be utilized as a service points rating systems. If the customer connects to the aforementioned wireless puck device and stays connected, the customer can set up the start and end of the loyalty rating. When the customer walks away, the wireless communication automatically disconnects.

Some embodiments of the invention are directed to a table game management system of the invention comprising a wireless puck device which, in some embodiments, can be used to receive data from player cards, such as by a card reading device which may be incorporated at the table or in connection with a card shuffler, or in some aspects, replace the player cards.

In some embodiments, the wireless puck device of the invention is configured to efficiently facilitate communication with a plurality of customers that enables and encourages the transfer of a plurality of player identification numbers associated with the player account in a loyalty or benefit program (e.g., playerIds) to the facilitating organization or operator, at the location of a table game, advantageously employing a plurality of computing devices, namely, player's personal computing devices, such as a smartphone, to facilitate the transfer of data between the smartphone and the wireless puck device, wherein the wireless puck device is in communication with a casino loyalty program management system or a database for storing such information and awarding points or other benefits responsive thereto.

In an embodiment, the invention provides a wireless puck device to facilitate communication with a plurality of customers which, among other things, enables receiving a plurality of customer identification numbers (e.g., customerIds) from the customers having previously received unique customer identification numbers associated with a customer benefits program, and then transmitting this data to the facilitating organization or operator, at service points, such as restaurants or bars, using a plurality of computing devices. The wireless puck device may be activated in a variety of ways, such as for example, being automatically activated responsive to being moved from a dock or cradle or activated through a physical interaction with a customer or the service point staff. The wireless puck device can be provided to the customer, such as by placing the wireless puck device in front of the customer. The customer then holds a computing device, such as a smartphone, in proximity of the wireless puck device, and either activates a software application, or initiates a wireless signal, such as Near Field Connection (NFC) connectivity, to communicate the customer identification number to the wireless puck device. The wireless puck device is picked up by the service point staff and either immediately or at some later point used to transfer the customer identification number to the service points management system.

Some embodiments of the invention are directed to a wireless puck device to facilitate a plurality of customers to connect with each other and to hand over a plurality of player identification numbers (playerIds) to a facilitating organization or operator, at a table game using a plurality of computing devices. The wireless puck device may be activated in a variety of ways, such as for example, being automatically activated responsive to being moved from a dock or cradle or activated through a physical interaction with a dealer. The wireless puck device can be provided to a player, such as by placing the wireless puck device at the player position on the table in front of a player, which may also advantageously enable the interaction between the player and the wireless puck device to be visible to the casino surveillance system. The player holds a computing device, such as a smartphone, within a proximity of the wireless puck device and activates a software application which may be stored in memory on the computing device, or initiates a wireless signal such as NFC connectivity, to communicate the player identification number to the wireless puck device. The wireless puck device may then be retrieved by the dealer and either immediately or at some later point used to transfer the player identification number to the table games management system.

In an aspect, the aforementioned wireless puck device facilitates the dealer identification of a player position at a gaming table to eliminate the need for the person to choose their location, among other things.

In an aspect, the aforementioned wireless puck device goes into scanning state after selection of the location, so that the user or players cannot change location.

In an aspect, the aforementioned wireless puck device is utilized by a plurality of players, which can be positional.

In an aspect, the dealer puts the aforementioned wireless puck device on a betting spot at a player position on a gaming table.

In an aspect, the aforementioned wireless puck device can be mounted at each seating position at a gaming table.

In an aspect, preferably, at least one wireless puck device can be placed per table or otherwise operatively associated with one or more tables.

In an aspect, the aforementioned wireless puck device can capture a patron's player number and can also capture additional information, such as the time the event occurred, to build an interface to the POS (Point of Sale), or the table game rating systems. This allows the user rating to be activated when the player actually starts playing (the supervisor currently backdates the time as needed).

In an aspect, the aforementioned wireless puck device can be integrated into a keyboard, or other standard input device.

In an aspect, a server or a port of sale terminal pertaining to the aforementioned wireless puck device can be installed at the facilitating organization's or operator's place of work, such as a restaurant.

In an aspect, the aforementioned wireless puck device can collect multiple numbers from the table, based on the user input.

In an aspect, the aforementioned wireless puck device includes memory that can store data, and a data communication device that can receive data to be stored in the memory and then transmit the stored data later.

In an aspect, the aforementioned wireless puck device includes a data communication device that can establish wireless communication with the computing devices of the players via wireless modules, such as Bluetooth Low Energy (BLE), or Near Field Communication (NFC), integrated within the computing devices. The wireless communications between the aforementioned wireless puck device and the computing devices of the players can be utilized as table games rating systems. If the player connects to the aforementioned wireless puck device and stays connected, the wireless puck device will receive data relating to the player's game play in a game at the gaming table so that the player could set up the start and end of the rating. When the player walks away, the wireless communication automatically disconnects.

Some embodiments of the invention are directed to a customer management system, comprising a wireless puck device residing at a live gaming table, the wireless puck device including a data storage device and a data communication device being configured to facilitate concurrent communication with one or more customers having customer user devices located proximal to the live gaming table, wherein the wireless puck device establishes a wireless connection with the customer user devices for data transfer between the data communication device and the customer user devices, whereby the wireless puck device facilitates the activation of a software application on the customer user device being configured to transmit a unique customer identification number to the data communication device, wherein the customer identification data is stored in the data storage device, the wireless puck device being further configured to form a data communication connection with a customer management system whereby the customer identification data is communication to the customer management system.

In some embodiments, data representing player activity at the live gaming table is received by the wireless puck device and associated with the customer responsive to the customer user device being located proximal to the live gaming table. The data representing player activity may be stored in the data storage device for communication to the customer management system. The customer management system may thereafter award loyalty points or other benefits to the customer based on the player activity illustrated by the data. For example, player activity may include playing card information received by the customer and others in the play of a game at the live gaming table, win or loss information for the customer and others at the live gaming table, and wagering information for the customer and others at the live gaming table.

In some embodiments, the wireless puck device is configured to communication with one or more electronic or data collecting devices associated with the live gaming table, such as a card reading device, card dealing shoe, shuffler device, display device, bet sensor, dealer interface, progressive jackpot system or a casino accounting system, all of which may be used to communication with the wireless puck device and associate player activity at the live gaming table with the customer based on the customer's position at the live gaming table and received customer identification.

Other features of embodiments of the invention will be apparent from accompanying drawings and from the detailed description that follows.

Yet other objects and advantages of the invention will become readily apparent to those skilled in the art, following the detailed description, wherein various presently preferred and exemplary embodiments of the invention are shown and described. As discussed herein, the invention is capable of other and different embodiments, and its several details are capable of modifications in various obvious respects, all without departing from the scope of the invention. Accordingly, the drawings and description thereof are to be regarded as illustrative in nature, and not as restrictive.

BRIEF DESCRIPTION OF THE DRAWINGS

These and other aspects of the systems and methods of the invention will become more readily apparent to those having ordinary skill in the art from the following description of an exemplary embodiment of the invention taken in conjunction with the accompanying drawings.

DETAILED DESCRIPTION OF SOME EMBODIMENTS OF THE INVENTION

The invention may be best understood with reference to the detailed figures and description set forth herein. Various embodiments have been discussed with reference to the figures. However, those skilled in the art will readily appreciate that the detailed descriptions provided herein with respect to the figures are merely for explanatory purposes, as the methods and systems may extend beyond the described embodiments. For instance, the teachings presented, and the needs of a particular application, may yield multiple alternative and suitable approaches to implement the functionality of any detail described herein. Therefore, any approach may extend beyond certain implementation choices in the following embodiments.

Embodiments of the invention may be provided as a computer program product, which may include a machine-readable storage medium tangibly embodying thereon instructions, which may be used to program a computer (or other electronic devices) to perform a process. The machine-readable medium may include, but is not limited to: fixed (hard) drives, magnetic tape, floppy diskettes, optical disks, compact disc read-only memories (CD-ROMs) and magneto-optical disks, semiconductor memories, such as read-only memories (ROMs), programmable read-only memories (PROMs), random access memories (RAMs), erasable PROMs (EPROMs), electrically erasable PROMs (EEPROMs), flash memory, magnetic or optical cards, or another type of media/machine-readable medium suitable for storing electronic instructions (e.g., computer programming code, such as software or firmware).

Various methods described herein may be practiced by combining one or more machine-readable storage media containing the code according to the invention with appropriate standard computer hardware to execute the code contained therein. An apparatus for practicing various embodiments of the invention may involve one or more computers (or one or more processors within a single computer) and storage systems containing or having network access to computer program(s) coded in accordance with various methods described herein, and the method steps of the invention could be accomplished by modules, routines, subroutines, or subparts of a computer program product.

The term "machine-readable storage medium," and/or "computer-readable storage medium," includes but is not limited to: portable or non-portable storage devices, optical storage devices, and various other mediums capable of storing, containing, or carrying instruction(s) and/or data. A machine-readable medium may include a non-transitory medium in which data can be stored, and that does not include carrier waves and/or transitory electronic signals propagating wirelessly or over wired connections. Examples of a non-transitory medium may include but are not limited to: a magnetic disk or tape, optical storage media such as compact disk (CD) or versatile digital disk (DVD), flash memory, memory, or memory devices.

Figure 1:
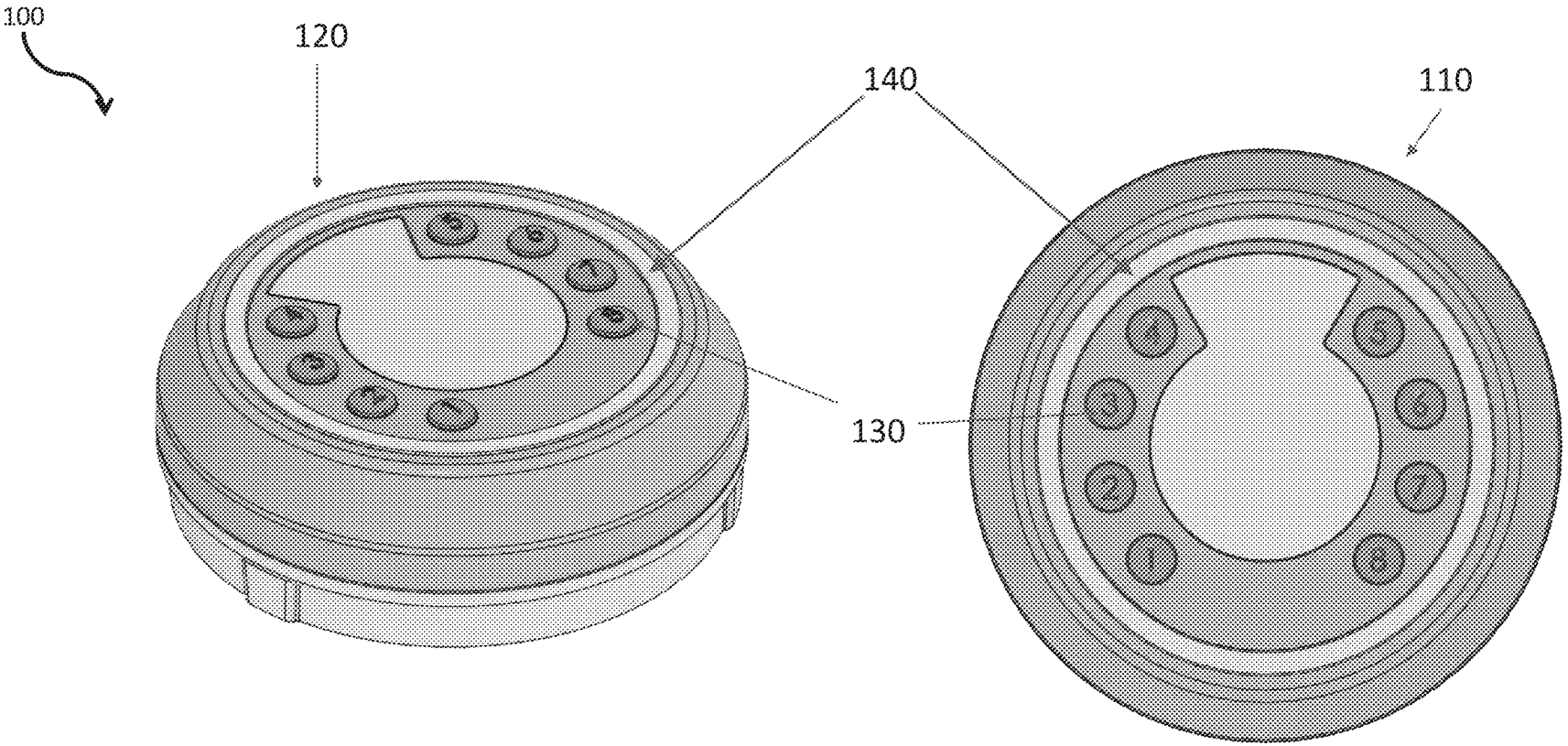
FIG. 1 illustrates a top view and a perspective view of a wireless puck device constructed in accordance with one embodiment of the invention.

FIG. 1 illustrates a top view 110 and a perspective view 120 of the wireless puck device 100, in accordance with one embodiment of the invention. The positions 130 shown as buttons 1-8 that can be activated by the dealer allowing the player to store the player identification number into a memory on the wireless puck device 100. As the player stores the player identification number into the wireless puck device 100, the player position outer ring 140 changes color to represent the player identification number having been stored. The outer ring 140 has multiple LED's that can display which position the player is seated and has one or more colors, indicating the state of the wireless puck device 100. In an embodiment, the outer ring 140 may glow in one color when it is ready to receive a player identification number, and then change to another color once the player has loaded their player identification number. The outer ring 140 may stop showing a color (or alternatively show a third color) when the player identification number has been loaded by the player into the table games management system.

Figure 2:
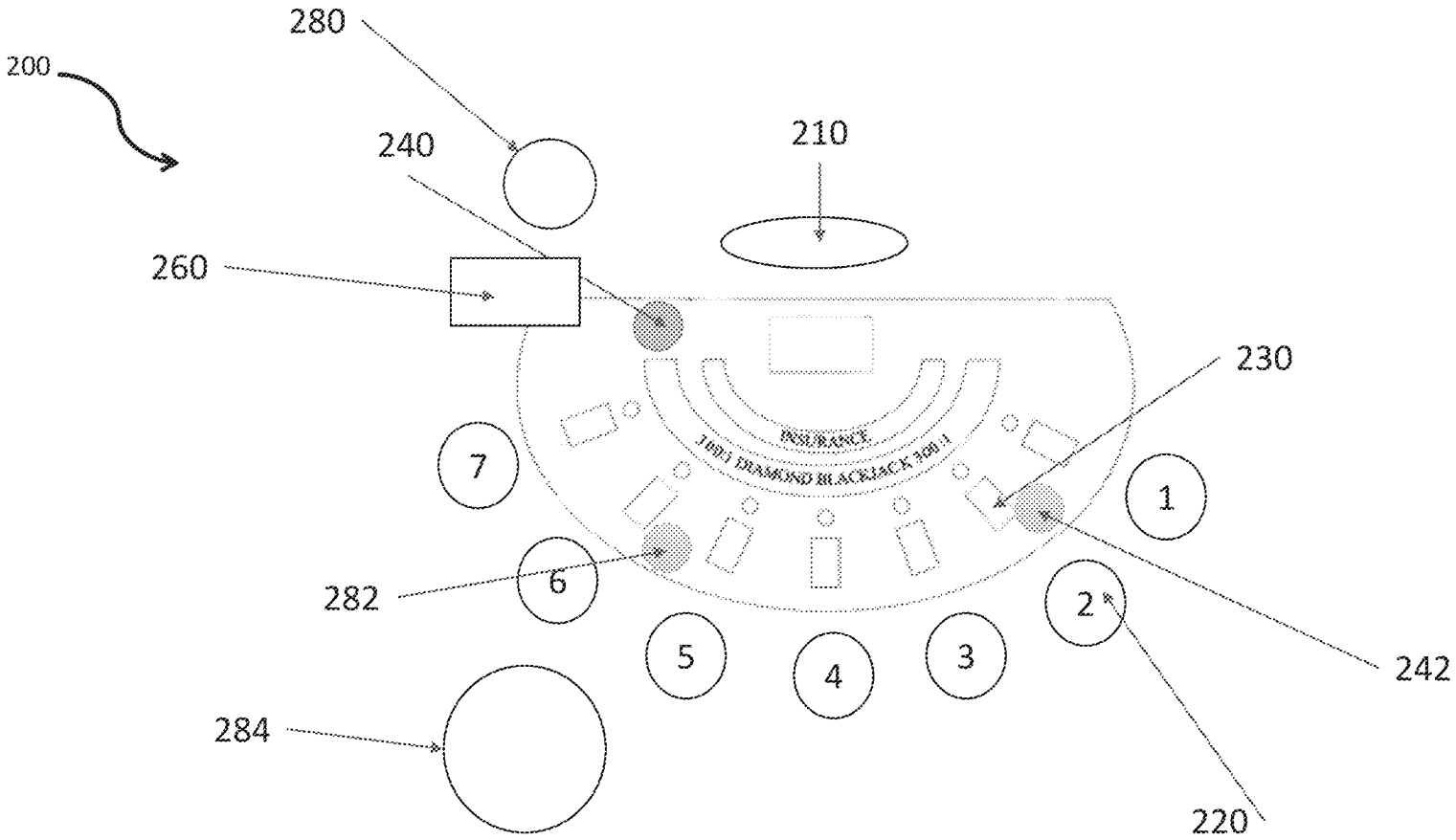
FIG. 2 illustrates a typical layout schematic of a blackjack card game, wherein the layout schematic applies to all the table games in accordance with an embodiment of the invention.

FIG. 2 illustrates an example of a typical layout schematic 200 of a blackjack card game, wherein the layout schematic 200 may also apply to other table games, in accordance with another embodiment of the invention. The first position 210 is the location where the dealer will typically stand to deal the cards to the players. The positions marked 1-7 220 represent the player positions or seat locations where the players sit to play the game on the table game. The second position 260 is the typical location of the table games management console, which in some embodiments is where the wireless puck device 100 is passed by to allow the stored number to be transferred to the table game management system. The third position 240 is the location where the wireless puck device is placed to transfer data to the table games management system. The fourth position 282 is an example of where the wireless puck device is placed for back betters to load their player identification card (it can be any location between betting positions). The fifth position 242 is an example of the location of where the wireless puck device is placed to allow the players to load their player identification number into the puck device. The sixth position 280 is the typical location of the supervisor where he/she will stand to transfer the information from the puck to the table games management system. The seventh position 230 is an example of an area in which the players are dealt cards, commonly referred to as the betting area.

Figure 3:
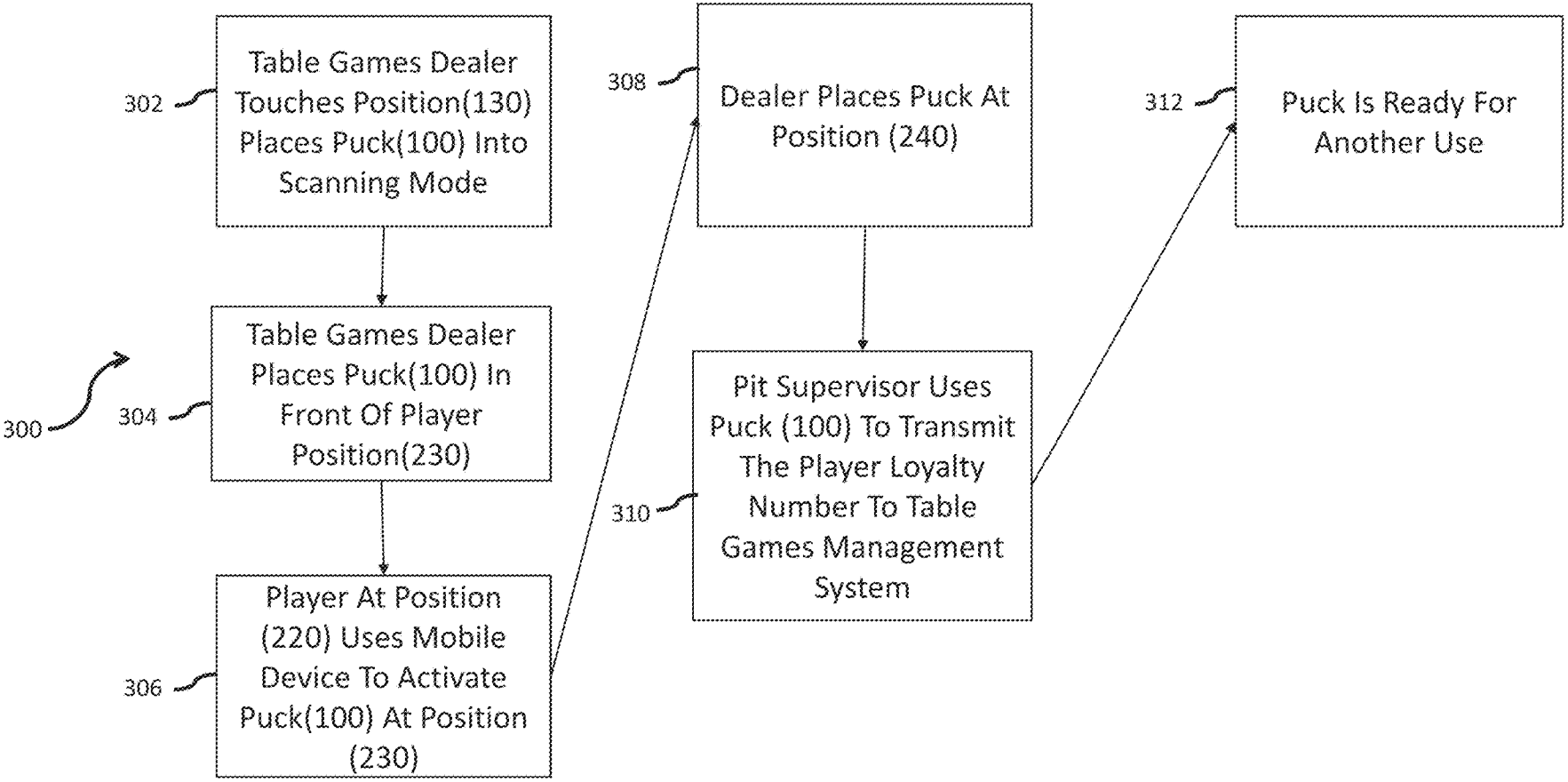
FIG. 3 illustrates an exemplary operational flowchart of the wireless puck device of FIG. 1 capturing the player identification number into the table game management system.

FIG. 3 illustrates an exemplary operational flowchart of the wireless puck device 100 being used to capture the player identification number into the table game management system in accordance with another embodiment of the invention. FIG. 3 is explained in conjunction with FIG. 1 and FIG. 2. The process initiates with step 302 of the table game dealer touching the player position marker 130 to change the condition of the wireless puck device 100 into the scanning mode. At step 304, the table games dealer places the wireless puck device 100 in front of the player position 230. At step 306, the player at position 220 uses a mobile device to activate or otherwise communicate a player identification number to wireless puck device 100 which is communicated with an identification of position 230. At step 308, the dealer places the wireless puck device at the third position 240. At step 310, the pit supervisor uses wireless puck device 100 to transmit the player loyalty number to the table games management system. At step 312, the wireless puck device 100 is ready for another use.

Examples of the computing devices 140 include but are not limited to: a mobile phone, a laptop, a desktop, a smartphone, a phablet, and a tablet. The wireless puck device facilitates the dealer to activate the wireless puck device and place the wireless puck device in front of the player. In some embodiments the player holds the computing device up to the wireless puck device, and either activates a software application residing in memory of the computing device, or initiates a wireless signal, such as BLE or NFC connectivity, to communicate the player identification number to a data communication device in the wireless puck device. The player identification number is stored in a memory on the wireless puck device which can then be retrieved by the dealer and either immediately or at some later point used to transfer the player identification number stored in memory to the table games management system. Typically, a table management system includes or otherwise maintains access to a player loyalty program including a player account database. The player identification number is used to identify the associated player account in the database which can then be updated thereafter based on the player's activity. The table management system also covers all aspects of managing and monitoring of live games within an establishment, based on the particular procedures and regulations imposed by the regulatory body or desired by management of the aforementioned establishment.

In operation, processes described herein can be enhanced to allow the player position markers 130 to also capture the player position. The player position capturing allows for additional players to store their player identification number into each position in the 130. When playing on a table game such as baccarat or blackjack players not playing the game but standing behind the player can also place their bets. These back-betters are difficult to capture so the gambling events are lost to the player tracking system and the table games management system.

Figure 4:
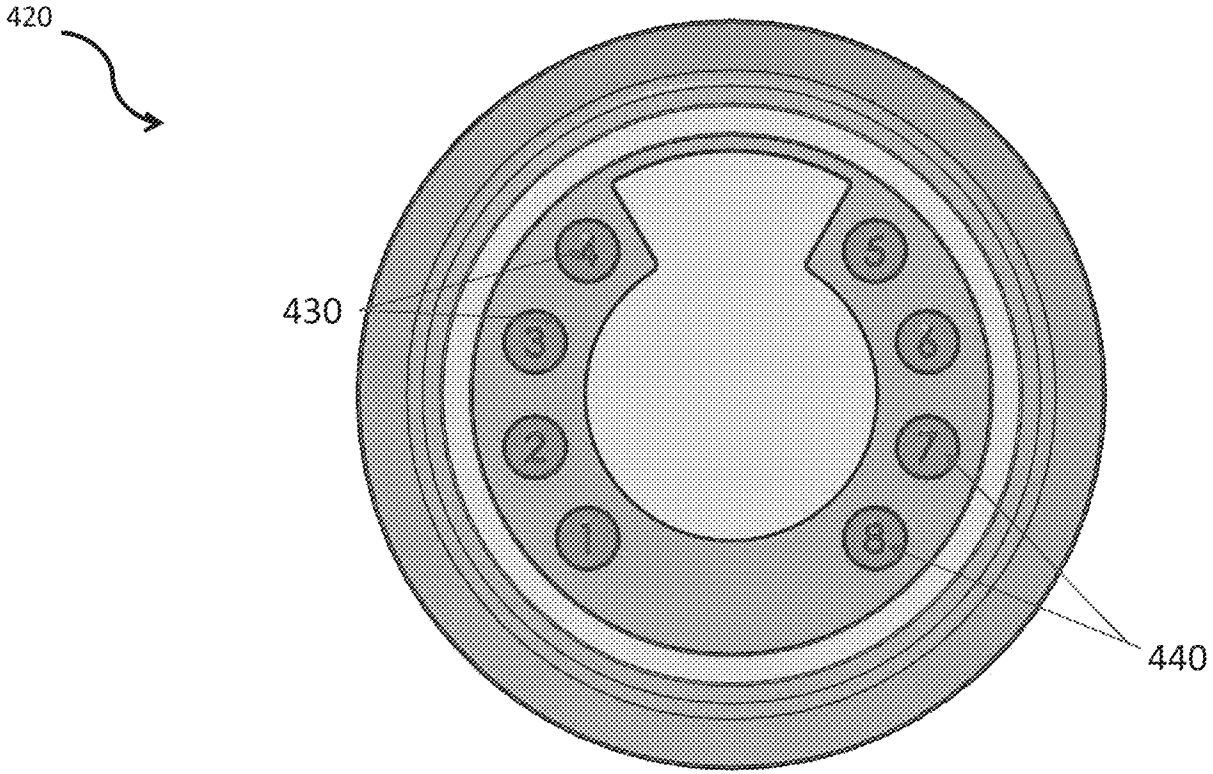
FIG. 4 illustrates an exemplary top-down view of the player positions 430 (or positions 130), where data from each player position can be captured.

FIG. 4 illustrates an exemplary top-down view 420 of the player positions 430 (or positions 130) where each player position can be captured, in accordance with another embodiment of the invention. In another embodiment the puck could have a variable number of positions ranging from 1-20. These positions would be showing in 430 as additional buttons and in 440 as variable numbers of back-betting positions. In another embodiment the puck could have multiple modes allowing for multiple virtual sets of capture positions using 430 and 440 for the actual button press. The multiple modes could be activated by clicking on a specific button 430 (or 130) twice for the second set of virtual locations and three times for the third set etc. In addition, the puck has positions 440 where back-betting players can be captured into the table games management system. The puck is shown as a top-down view 420 similar to 110 for the non-back betting version of the puck.

Figure 5:
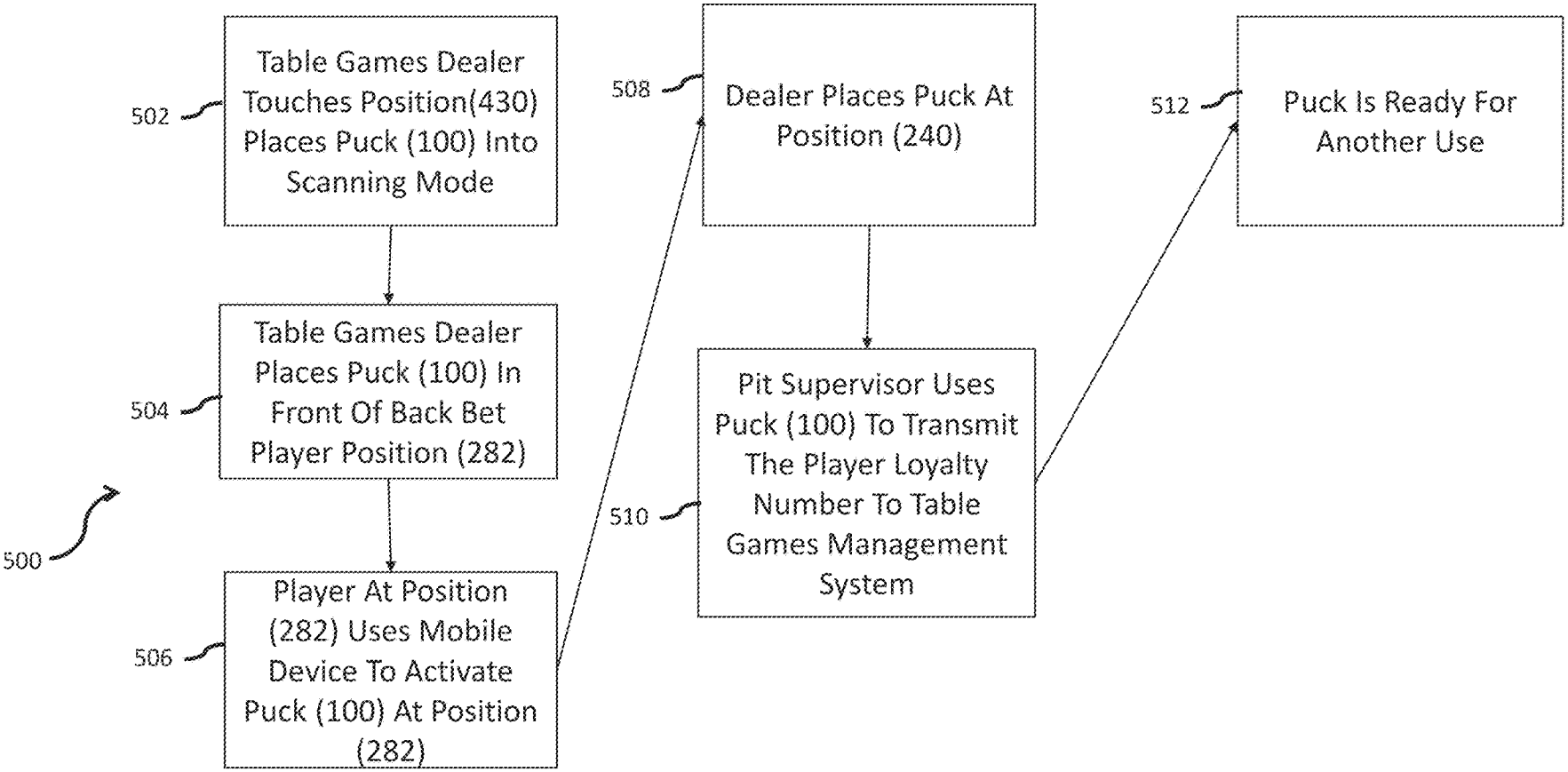
FIG. 5 illustrates a flowchart for a back-betting player loading their player identification number into the table games management system.

FIG. 5 illustrates a flowchart 500 for the back-betting player loading their player identification number into the table games management system, in accordance with another embodiment of the invention. FIG. 5 is explained in conjunction with FIG. 1, FIG. 2 and FIG. 4. At step 502, the table games dealer touches position 430 (places the wireless puck device 100) into scanning mode. At step 504, the table games dealer places the wireless puck device 100 in front of back bet player position 282. At step 506, the player at position 282 uses a mobile device to activate the wireless puck device 100 and communicate the player identification number at position 282. At step 508, the dealer places the wireless puck device 100 at position 240. At step 510, the pit supervisor uses the wireless puck device 100 to transmit the player loyalty number to the table games management system. At step 512, the wireless puck device 100 is ready for another use.

Thus, wireless puck device 100 allows loading of a player identification number via a wireless signal to the wireless puck device 100. After the number is stored in the wireless puck device 100, then it follows the aforementioned processes to allow the player identification number to be loaded into the table games management system.

Figure 6:
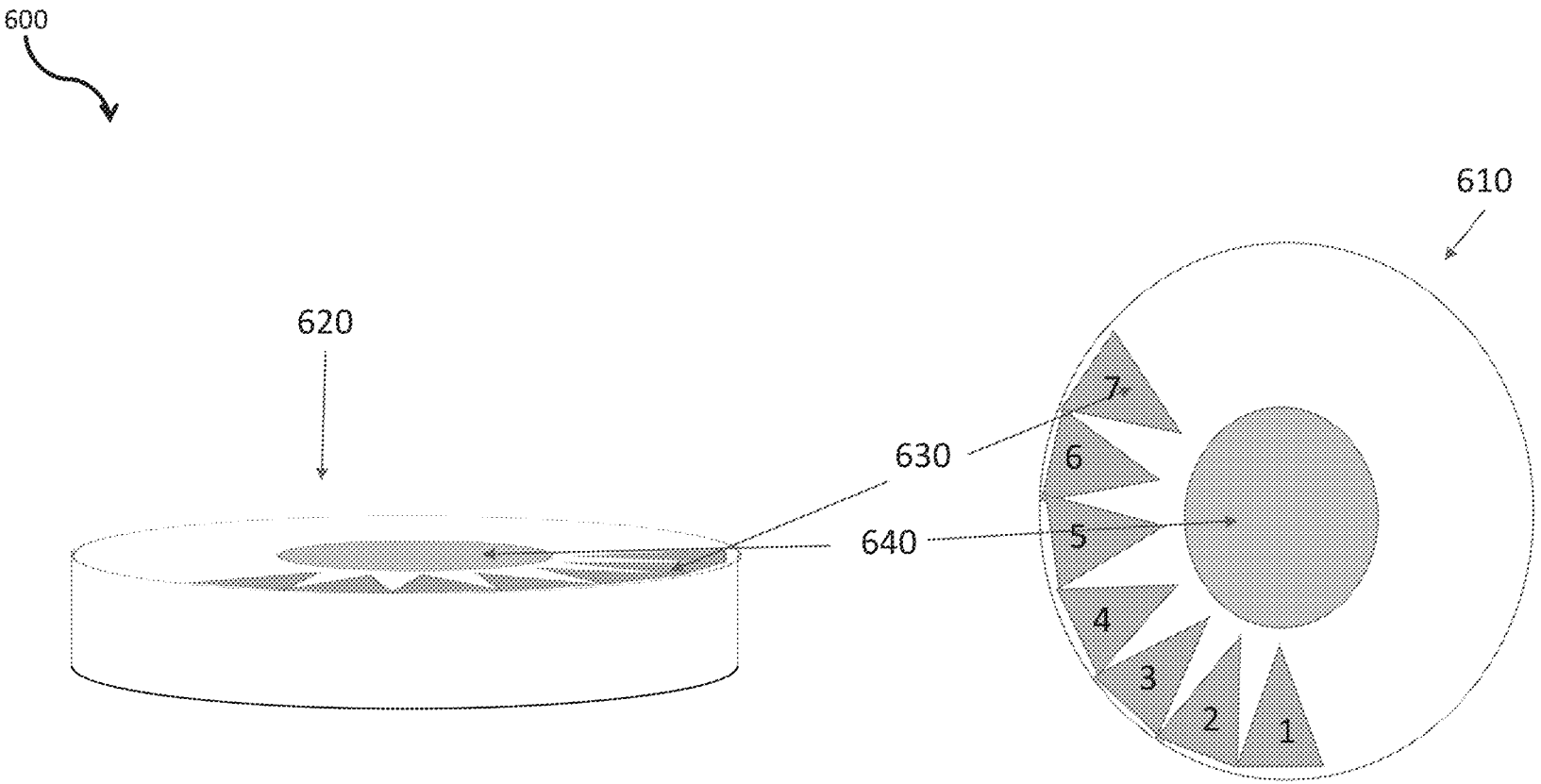
FIG. 6 illustrates a top view and a perspective view of a wireless puck device constructed in accordance with another embodiment of the invention.

FIG. 6 illustrates a top view 610 and a perspective view 620 of a wireless puck device 600 constructed in accordance with another embodiment of the present invention. The positions 630 shown as triangles 1-7 are lighted areas that can be activated by the service point staff allowing the customer to store the customer identification number into a memory on the wireless puck device 600. As the customer stores the customer identification number into the wireless puck device 600, the customer position marker 630 changes color to represent the customer identification number having been stored. Alternatively, the center dome 640 can change color to indicate the customer identification number has been stored. The center dome 640 is a light that can hold one or more colors, indicating the state of the wireless puck device 600. In an embodiment, the center dome 640 may glow in one color when it is ready to receive a customer identification number, and then change to another color once the customer has loaded their customer identification number. The center dome 640 may stop showing a color (or alternatively show a third color) when the customer identification number has been loaded by the customer into the service points management system.

Figure 7:
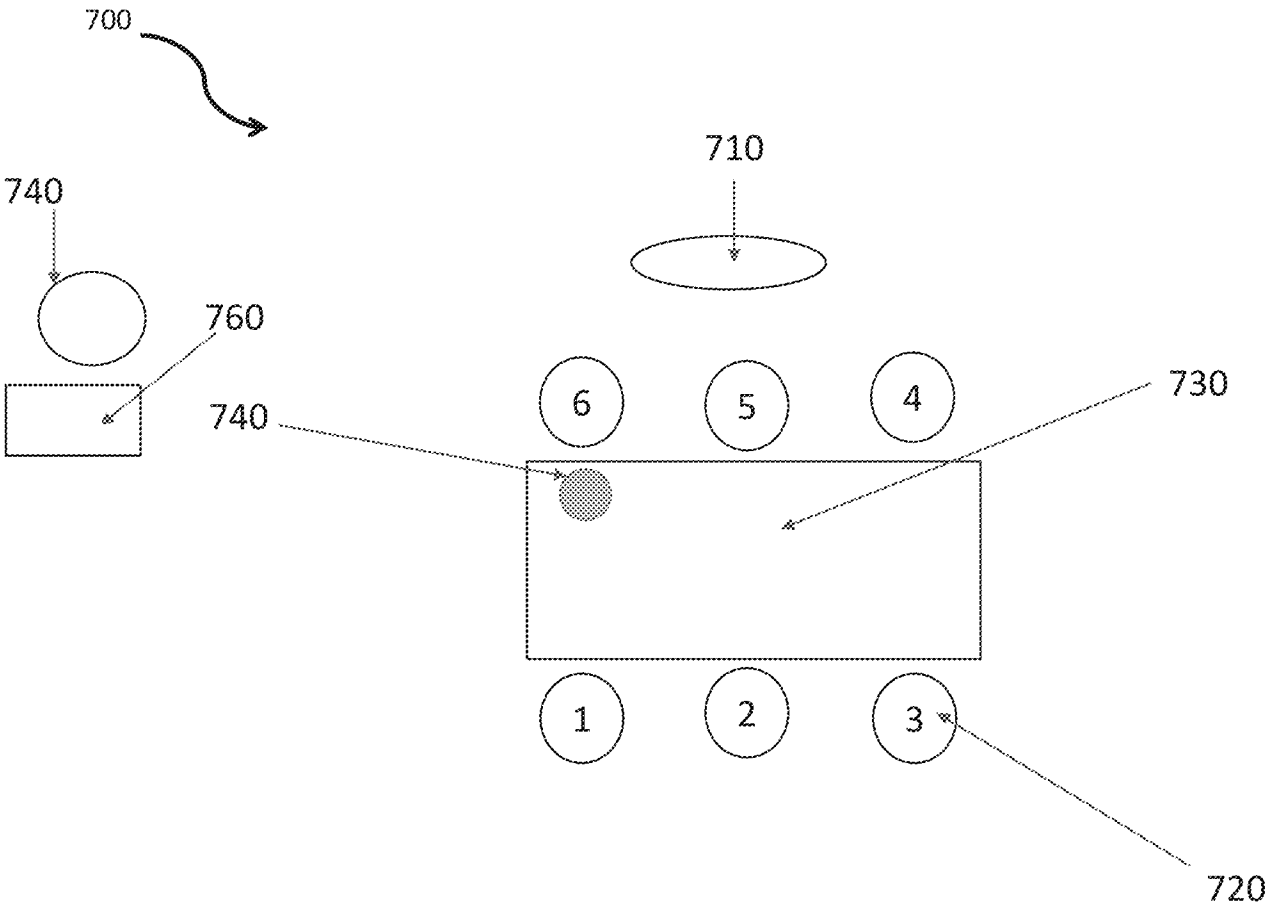
FIG. 7 illustrates a typical layout schematic of a typical restaurant table, wherein the layout schematic applies to all the service points, including and not limited to bars.

FIG. 7 illustrates an example of a typical layout schematic 700 of a restaurant table, wherein the layout schematic 700 may also apply to all other service points, in accordance with another embodiment of the present invention. The first position 710 is the location where the service point staff will typically stand to first communicate with the customers. The positions marked 1-6 720 are the seat locations where the customers sit to eat their food. The second position 760 is the typical location of the service points management console, which in some embodiments is typically some distance from the table, and it is where the wireless puck device is passed by to allow the stored number to be transferred to the service point management system. In another embodiment the service point 760 can be mobile and carried by the waiter to the table. The third position 740 is the location where the wireless puck device is placed to transfer data to the service points management. The fourth position 730 is the table at which customers eat are expected their food.

Figure 8:
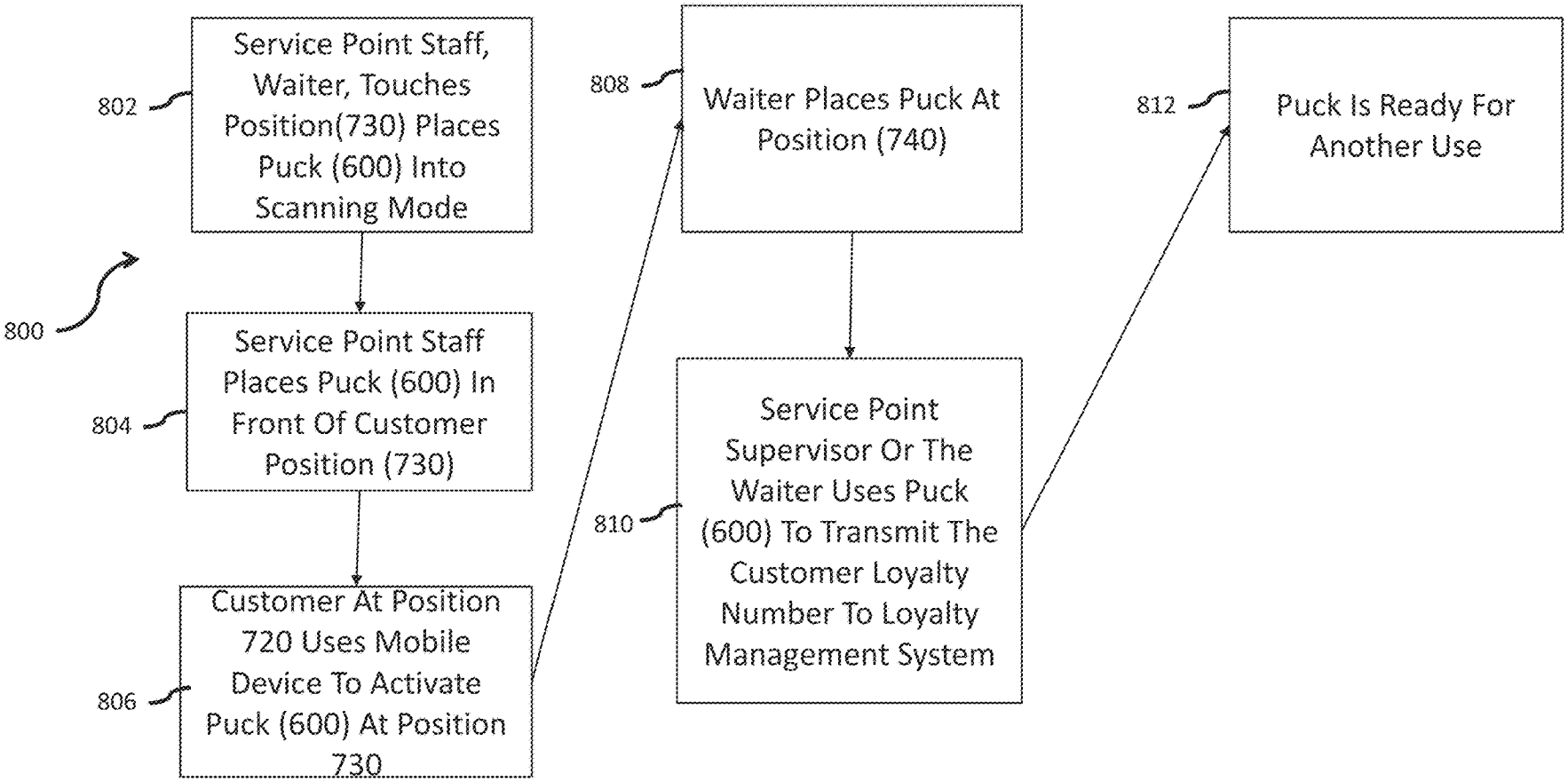
FIG. 8 illustrates an exemplary operational flowchart of the wireless puck device shown in FIG. 6 in use to capture the customer identification number into the service point management system of FIG. 7.

FIG. 8 illustrates an exemplary operational flowchart of the present wireless puck device to capture the customer identification number into the service point management system, in accordance with another embodiment of the present invention. FIG. 8 is explained in conjunction with FIG. 6 and FIG. 7. The process initiates with step 802 of the service point service point staff touching the customer position marker 630 to change the condition of the wireless puck device 600 into the scanning mode. At step 804, the service point staff places the present wireless puck device 600 in front of the customer position 730. At step 806, the customer at position 720 uses a mobile device to activate or otherwise communicate a customer identification number to wireless puck device 600 which is communicated with an identification of position 730. At step 808, the service point staff places the wireless puck device at the third position 740. At step 810, the restaurant supervisor uses wireless puck device 600 to transmit the customer loyalty number to the service points management system. At step 812, the wireless puck device 600 is ready for another use.

Thus, the wireless puck device 600 allows loading of a customer identification number via a wireless signal to the wireless puck device 600. After the number is stored in the present wireless puck device, 600 then it follows the aforementioned processes to allow the customer identification number to be loaded into the service points management system.

It should be readily apparent that the systems and methods of the invention may be deployed in connection with any customer service points, including any POS terminal or gaming platform, such as electronic gaming machines, slot machines as well as kiosks, electronic and non-electronic live gaming tables, sportsbooks, keno, e-sports and gaming terminals.

Those skilled in the art will also readily appreciate that such systems and devices configured in accordance with this invention may include or employ various specialized and/or non-specialized computer and network related software and hardware, such as software and hardware which are used in a distributed computing network, that is, programs, operating systems, memory storage devices, input/output devices, data processors, servers with communication links, wireless or otherwise.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality. However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware, or hardware, and when embodied in software, could be downloaded to reside on and be operated from different platforms used by a variety of operating systems.

While exemplary systems, devices and methods, and applications of methods of the invention using such devices, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Additional information regarding features of exemplary embodiments of the invention is provided below.

In some embodiments, the methods, systems, and media disclosed herein include at least one computer program, or use of the same. A computer program includes a sequence of instructions, executable in the digital processing device's CPU, written to perform a specified task. Computer readable instructions may be implemented as program modules, such as functions, objects, Application Programming Interfaces (APIs), data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, one or more web browser plug-ins, extensions, add-ins, or add-ons, or combinations thereof.

In some embodiments, the methods, systems, and media disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

In some embodiments, the methods, systems, and media disclosed herein include one or more databases, or use of the same. In view of the disclosure provided herein, those of skill in the art will recognize that many databases are suitable for storage and retrieval of player and game information. In various embodiments, suitable databases include, by way of non-limiting examples, relational databases, non-relational databases, object oriented databases, object databases, entity-relationship model databases, associative databases, and XML databases. In some embodiments, a database is internet-based. In further embodiments, a database is web-based.

In still further embodiments, a database is cloud computing-based. In other embodiments, a database is based on one or more local computer storage devices.

A controller, computing device, computer or server, such as described herein, may include at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

While exemplary apparatus, systems and methods of the invention have been described herein and in the accompanying documents, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth herein, by the claims and any equivalents thereto.

The invention claimed is:

1. A customer management system, comprising:

a wireless puck device configured to be movable to a plurality of positions residing at a live gaming table, including a first position and a second position residing at the live gaming table, the wireless puck device including a data storage device and a data communication device being configured to facilitate concurrent communication with a customer playing in a game at the live gaming table having a customer user device located proximal to the first position, wherein movement of the wireless puck device to the first position establishes a wireless connection between the data communication device and the customer user device to enable data transfer between the data communication device and the customer user device, whereby the wireless puck device facilitates activation of a software application on the customer user device, the software application being configured to transmit a unique customer identification number to the data communication device, wherein the customer identification number is stored in the data storage device, the wireless puck device being further configured to form a data communication connection with a customer management system when moved to the second position, whereby the customer identification number for the customer is communicated to the customer management system.

2. The customer management system of claim 1, wherein data representing player activity at the live gaming table is received by the wireless puck device and associated with the customer responsive to the customer user device being located proximal to the live gaming table, wherein the data representing player activity is stored in the data storage device in association with the customer identification number.

3. The customer management system of claim 2, further comprising a third position residing at the live gaming table, wherein movement of the wireless puck device to the third position establishes a wireless connection between the data communication device and a second customer back-betting on a game at the live gaming table, the second customer having a second customer user device located proximal to the third position, whereby the wireless puck device facilitates activation of the software application on the second customer user device and the customer identification number for the second customer is stored in the data storage device.

* * * * *